US006622676B1

(12) United States Patent
Pierik et al.

(10) Patent No.: US 6,622,676 B1
(45) Date of Patent: Sep. 23, 2003

(54) ECCENTRIC GROOVES FOR INTERSECTING LONGITUDINAL FLUID SUPPLY PASSAGES

(75) Inventors: Ronald J. Pierik, Rochester, NY (US); Dominic Borraccia, Spencerport, NY (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 10/306,243

(22) Filed: Nov. 27, 2002

(51) Int. Cl.[7] ..... F01L 1/34

(52) U.S. Cl. ..... 123/90.15; 123/90.17; 123/90.16; 137/580; 277/591

(58) Field of Search ..... 137/580; 123/90.15–90.18, 123/90.31, 90.37; 277/591

(56) References Cited

U.S. PATENT DOCUMENTS 6,199,524 B1 * 3/2001 Ushida ..... 123/90.17

* cited by examiner

*Primary Examiner*—Thomas Denion
*Assistant Examiner*—Kyle Riddle
(74) *Attorney, Agent, or Firm*—Patrick M. Griffin

(57) ABSTRACT

A cylindrical element having a first axis and at least one internal longitudinal passage, and a circular circumferential groove formed in an outer surface of the element and having a second axis. The groove eccentric of the element such that the groove intersects the wall of the longitudinal passage, forming thereby a rectangular opening therebetween. When a second longitudinal passage is present, it is similarly intersected by a second eccentric groove spaced apart axially from the first groove. The axis of the second groove is rotationally displaced about the element axis from the first groove, preferably by a large angle, for example 180°, such that the first eccentric groove does not intersect the second passage, nor does the second eccentric groove intersect the first passage. The invention is useful in forming a central plug or bolt for a cam phaser for an internal combustion engine wherein oil must be supplied between a switching valve and a phaser element via the plug or bolt to advance and retard valve timing.

8 Claims, 3 Drawing Sheets

ECCENTRIC GROOVES FOR INTERSECTING LONGITUDINAL FLUID SUPPLY PASSAGES

TECHNICAL FIELD

The present invention relates to means for changing the flow of fluid from longitudinal flow through a longitudinal passage in an element to radial flow through the element; more particularly, to the geometric relationship between intersecting passages for effecting such directional change; and most particularly, to a cylindrical element having longitudinal fluid supply passages intersected by eccentric grooves formed in a surface of the element.

BACKGROUND OF THE INVENTION

Cam phasers for varying the phase relationship between the pistons and the valves of an internal combustion engine are well known. In some applications, pressurized phaser control oil is supplied from a passage in a camshaft bearing at the rear of the phaser to a fixed oil switching valve mounted on the exterior of the phaser cover at the front of the phaser via one or more first longitudinal passages in a central bolt or plug. The switching valve, on command from an engine control module, supplies oil to, or recovers oil from, opposite-acting timing advance and retard chambers within the phaser. Typically, the switching valve is connected to the chambers via radial passages in a phaser element which communicate with second longitudinal passages in the central plug. Because the angular relationship between the plug and the phaser element may be variable, typically a circumferential oil groove concentric with the plug is formed in the outer surface of the plug at the axial location of the radial passage in the phaser element, giving the phaser element access to the second longitudinal passage regardless of rotation between the plug and the phaser element. In the prior art, the groove and the longitudinal passage in the plug are connected via a radial bore therebetween, which scheme has at least two disadvantages: first, the bore requires separate tooling and machining in forming the plug, thereby increasing cost and complexity; and second, the opening formed into the second passage can be no larger than a bore having a diameter equal to the axial width of the groove, thereby limiting for some applications the maximum oil flow possible.

What is needed is a means for obviating the need for a separate radial bore and a means for increasing the open area between a longitudinal passage and a circumferential groove.

It is a principal object of the present invention to reduce the cost and complexity of manufacturing a cam phaser.

It is a further object of the invention o reduce flow restriction of oil between a longitudinal passage and a circumferential groove.

SUMMARY OF THE INVENTION

Briefly described, a cylindrical element formed in accordance with the invention has a first axis and at least one internal, longitudinal passage. A circular circumferential groove, having a second axis and preferably a rectangular cross-section, is formed in an outer surface of the element. The groove axis is parallel to the element axis but is offset radially, making the groove eccentric of the element, such that the groove intersects and breaks through the wall of the longitudinal passage, forming thereby a rectangular opening therebetween. The axial extent of the opening equals the axial width of the groove, and the circumferential extent of the opening is governed by the inter-axial distance.

This effect can be achieved, of course, by a concentric groove rather than eccentric groove. However, when a second longitudinal passage also must be intersected by a second groove, making the second groove also concentric is not readily feasible. The invention, though, using eccentric grooves, makes it easy to accommodate a second passage. The second eccentric groove is spaced apart axially from the first groove and the axis of the second groove is rotationally displaced about the element axis from the first groove, preferably by a large angle, for example 180°, such that the first eccentric groove does not intersect the second passage, nor does the second eccentric groove intersect the first passage. Greater numbers of passages and grooves are possible, limited by the diameters of the grooves, the positioning of the passages in the element, the diameter of the element, and the depth of the grooves.

In practice, the invention is highly useful in forming a central plug or bolt for a cam phaser for an internal combustion engine wherein oil must be supplied between a switching valve and a phaser element via the plug or bolt.

The invention is also useful in the inverse situation wherein the longitudinal passage (or passages) is formed in an object parallel to a cylindrical bore therein, and the eccentric groove (or grooves) is formed in the wall of the bore.

BRIEF DESCRIPTION OF THE DRAWINGS

These and other features and advantages of the invention will be more fully understood and appreciated from the following description of certain exemplary embodiments of the invention taken together with the accompanying drawings, in which.

DESCRIPTION OF THE PREFERRED EMBODIMENTS

Figure 1:
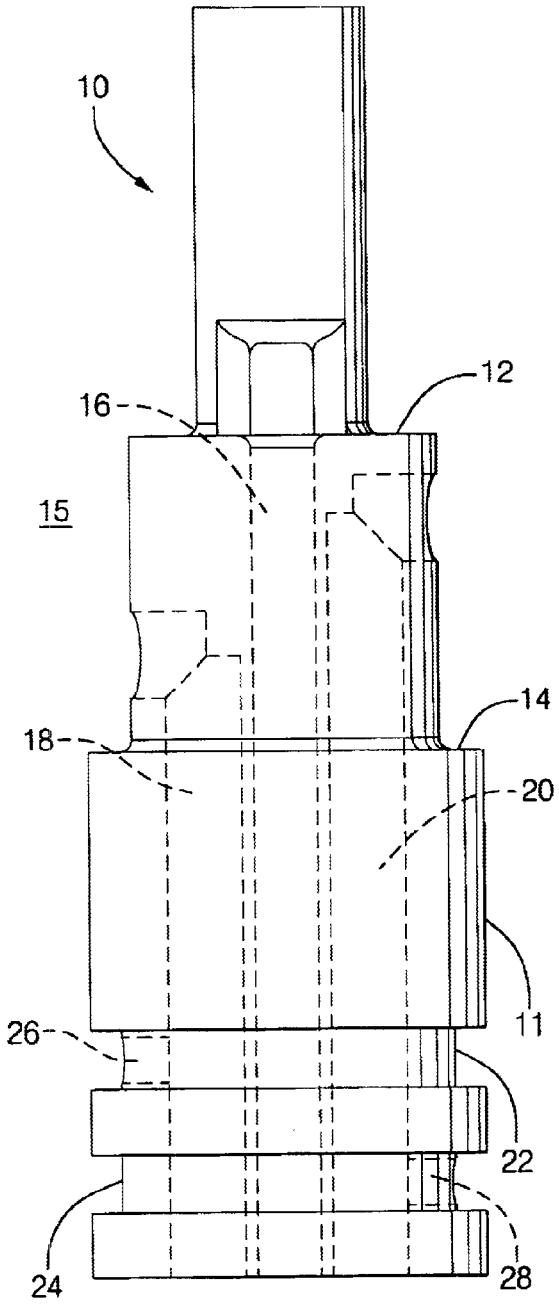
PRIOR ART FIG. 1
FIG. 1 is an elevational view of a prior art element having concentric oil grooves and radial bores connecting the bores with longitudinal oil passages.

Referring to FIG. 1, a prior art element 10 has a generally cylindrical body 11 which includes, for example, annular steps 12,14 to enable element 10 to interface with surrounding cylindrical apparatus, for example, a cam phaser 15 for an internal combustion engine (not shown). As a cam phaser component, element 10 is provided with two longitudinal oil supply passages 16 (superimposed in FIG. 1 but seen separately in FIG. 3) for supplying engine oil from an engine source (not shown) to a switching valve (not shown) and first and second longitudinal oil return passages 18,20 for returning oil from the switching valve to advance and retard chambers (not shown), respectively, of the cam phaser. Element 10 also is provided with first and second annular grooves 22,24 spaced apart axially along body 11, which communicate with passages 18,20 via first and second radial bores 26,28, respectively. Grooves 22,24 are concentric with element body 11, defining respective oil galleries surrounding element body 11. Thus, in operation, fluid flowing axially of body 11 through passages 18,20 is turned to flow radially through bores 26,28 in entering grooves 22,24.

Figure 2:
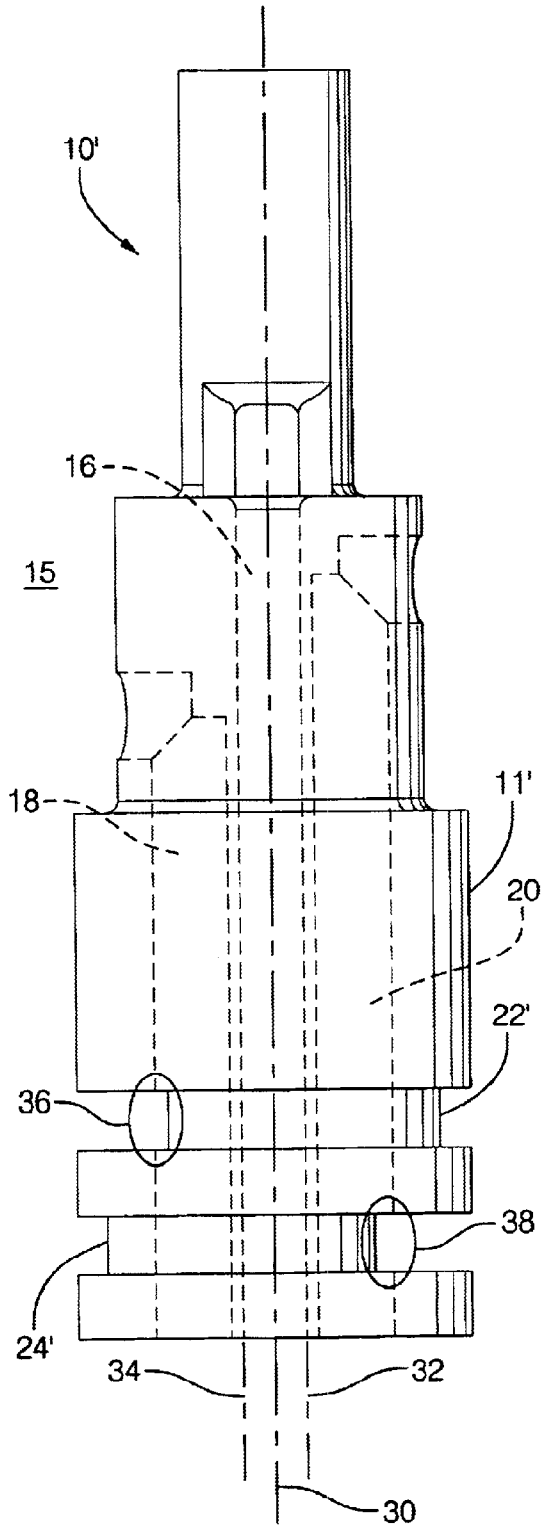
FIG. 2 is an elevational view of a first embodiment of the invention, showing an element similar to the prior art element of FIG. 1 in having longitudinal oil passages, but having eccentric oil grooves intersecting the passages in accordance with the invention.
Figure 3:
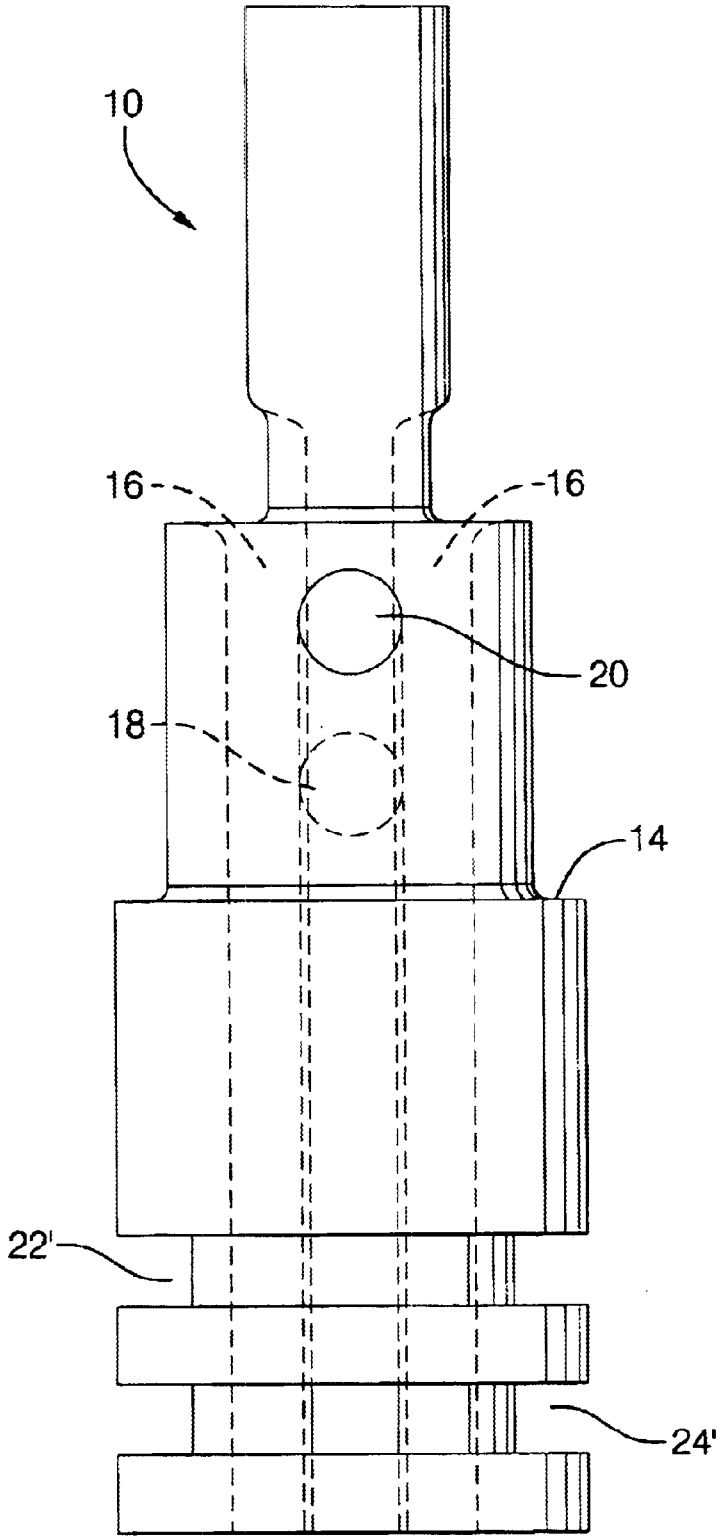
FIG. 3 is a second elevational view of the novel element shown in FIG. 2, taken after axial rotation of 90°.
Figure 4:
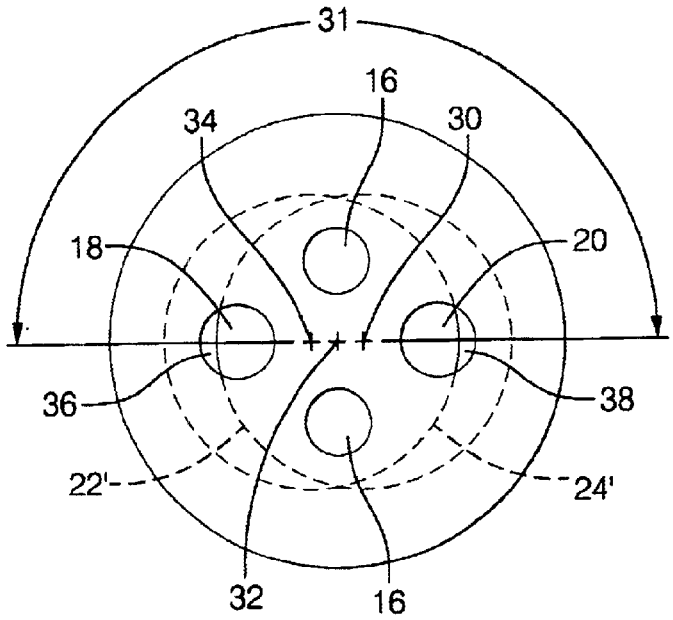
FIG. 4 is a bottom view of the element shown in FIGS. 2 and 3.

Referring to FIGS. 2 through 4, an improved element 10' in accordance with the invention has a generally cylindrical body 11' similar to body 11, has longitudinal supply passages 16, and has longitudinal return passages 18,20. In fact, element 10' is functionally identical with prior art element 10 and serves the same functional purpose. Where element 10' differs is that improved first and second annular grooves 22',24' are not concentric with element body 11', but rather are eccentric of body 11', as shown in FIGS. 2 and 4. Axis 30 of first groove 22' is parallel to, and displaced radially by a distance from, axis 32 of body 11'; and axis 34 of second groove 24' is parallel to, and displaced radially by an equal distance but in the opposite direction from, axis 32; i.e., axis 34 is displaced rotationally from axis 30 by an angle 31 about axis 32, preferably about 180°.

The distance by which axes 30,34 are displaced from axis 30 is selected such that grooves 22',24' intersect passages 18,20, at points 36,38, respectively, to create rectangular openings between the grooves and the passages. Depending upon placement of the passages and the diameters and displacements of the grooves, the openings may have circumferential dimensions as great as the diameters of the passages. The fact that the grooves are eccentric of the element body does not impair their function as circumferential supply galleries. Element 10' may be an element in a cam phaser 15, for example, a central bolt for securing the cam phaser to an internal combustion engine.

Figure 5:
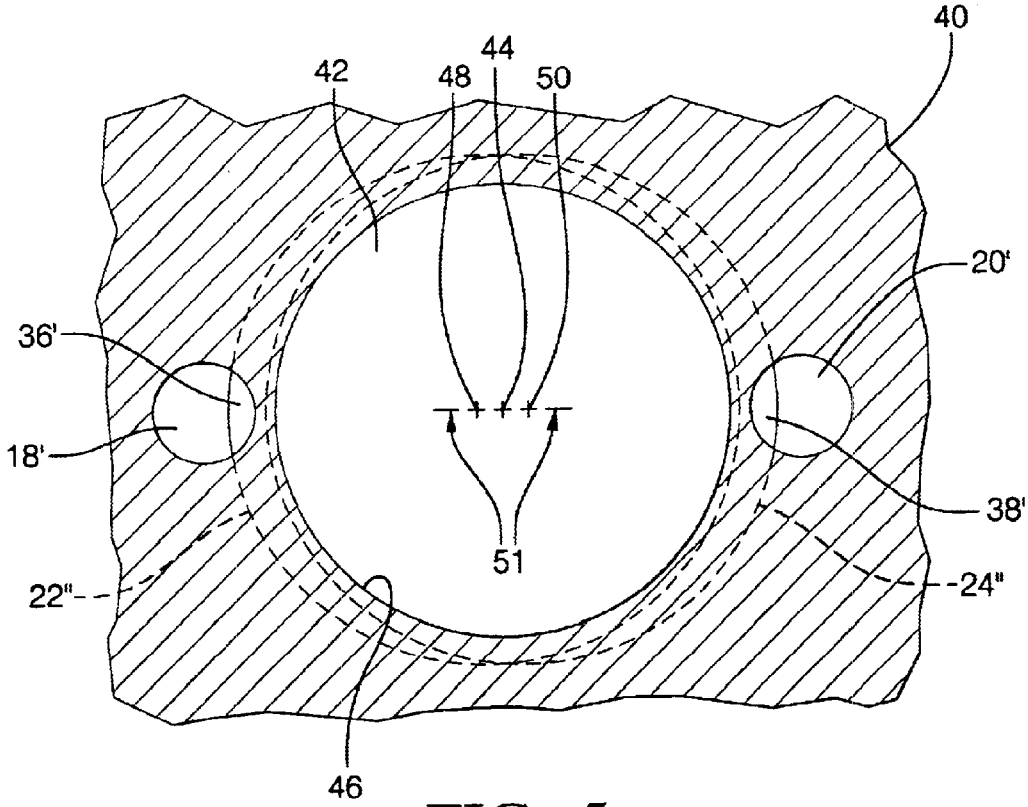
FIG. 5 is a cross-sectional view of a second embodiment in accordance with the invention.

Referring to FIG. 5, the invention may be employed in an inverse arrangement. Longitudinal passages 18',20' are formed in an element 40 outboard of bore 42 having longitudinal axis 44 and wall 46 and it is desired that circumferential supply galleries in the wall of the bore be in communication with the longitudinal passages. Such communication when provided in accordance with the prior art can be difficult and time-consuming, as it requires accurate drilling of radial bores outwards from bore 42 in the circumferential grooves to intersect the passages and, if the radial bores are drilled inward from the outside of element 40, plugging of a portion of the radial bores that communicate from the groove to the outside of element 40. In accordance with the invention, eccentric grooves 22",24" have first and second axes 48,50, respectively, and are displaced rotationally from each other by an angle 51 about axis 44, preferably about 180°. Grooves 22",24" are readily formed by rotary machining in bore 42, intersect passages 18',20' at points 36',38', thus obviating the need for separate radial bores as in the prior art.

While the invention has been described by reference to various specific embodiments, it should be understood that numerous changes may be made within the spirit and scope of the inventive concepts described. Accordingly, it is intended that the invention not be limited to the described embodiments, but will have full scope defined by the language of the following claims.

What is claimed is:

1. A solid cylindrical element having a longitudinal axis, comprising:

a first longitudinal passage for flow of a fluid therethrough; and a first circumferential groove formed in the cylindrical surface of said element, said groove having a longitudinal axis parallel to and non-coincident with said element axis, said groove axis being eccentrically displaced from said element axis such that said groove intersects said passage to form a conjoining opening for radial flow communication between said passage and said cylindrical surface of said element.

2. An element in accordance with claim 1 further comprising:

a second longitudinal passage for flow of a fluid therethrough; and a second circumferential groove formed in said cylindrical surface of said element and axially displaced from said first groove, said second groove having a second longitudinal axis parallel to and non-coincident with said element axis, said second groove axis being eccentrically displaced from said element axis such that said second groove intersects said second passage to form a conjoining opening for radial flow communication between said second passage and said cylindrical surface of said element, said second axis being rotationally displaced from said first axis through a central angle about said element axis.

3. An element in accordance with claim 2 wherein said central angle is about 180°.

4. An element in accordance with claim 2 wherein said element is a component of a cam phaser for an internal combustion engine.

5. An element in accordance with claim 4 wherein said component is a central bolt for securing said cam phaser to said engine.

6. A solid element, comprising:

a cylindrical bore having a longitudinal axis and a bore wall;

a first longitudinal passage adjacent said cylindrical bore for flow of a fluid therethrough; and a first circumferential groove formed in said bore wall, said groove having a longitudinal axis parallel to and non-coincident with said bore axis, said groove axis being eccentrically displaced from said bore axis such that said groove intersects said passage to form a conjoining opening for radial flow communication between said passage and said cylindrical bore.

7. An element in accordance with claim 6 further comprising:

a second longitudinal passage adjacent said cylindrical bore for flow of a fluid therethrough; and a second circumferential groove formed in said bore wall and axially displaced from said first groove, said second groove having a second longitudinal axis parallel to and non-coincident with said bore axis, said second groove axis being eccentrically displaced from said bore axis such that said second groove intersects said second passage to form a conjoining opening for radial flow communication between said second passage and said cylindrical bore, said second axis being rotationally displaced from said first axis through a central angle about said bore axis.

8. An element in accordance with claim 7 wherein said central angle is about 180°.

* * * * *